US012628953B2

(12) United States Patent
Hess

(10) Patent No.: US 12,628,953 B2
(45) Date of Patent: May 19, 2026

(54) BACKPACK FRAME CONVERTIBLE TO FOLDING CHAIR

(71) Applicant: Troy Anthony Hess, Liverpool, PA (US)

(72) Inventor: Troy Anthony Hess, Liverpool, PA (US)

( * ) Notice: Subject to any disclaimer, the term of this patent is extended or adjusted under 35 U.S.C. 154(b) by 153 days.

(21) Appl. No.: 18/367,611

(22) Filed: Sep. 13, 2023

(65) Prior Publication Data

US 2024/0081535 A1 Mar. 14, 2024

Related U.S. Application Data

(60) Provisional application No. 63/406,284, filed on Sep. 14, 2022.

(51) Int. Cl.
*A47C 4/04* (2006.01)
*A45F 4/02* (2006.01)

(52) U.S. Cl.
CPC ..... *A47C 4/04* (2013.01); *A45F 4/02* (2013.01); *A45F 2004/026* (2013.01)

(58) Field of Classification Search
CPC ..... A45F 2004/026; A47C 4/18; A47C 4/42
USPC ..... 224/155
See application file for complete search history.

(56) References Cited

U.S. PATENT DOCUMENTS 3,250,449 A * 5/1966 Woodman ..... A45F 4/02 224/155
3,912,138 A * 10/1975 Pava ..... A45F 4/04 24/453
5,303,975 A * 4/1994 Asato ..... A45F 4/02 224/155
5,318,342 A 6/1994 Hale
5,381,941 A 1/1995 Brune
5,547,246 A * 8/1996 Lambert ..... A47C 13/00 297/118
5,597,101 A 1/1997 Barber et al.
6,145,716 A 11/2000 Caicedo
7,052,081 B2 * 5/2006 Leng ..... A47C 3/045 297/58
7,118,172 B1 10/2006 Pattison-Sheets
8,113,396 B2 * 2/2012 Schilly ..... A45F 3/047 224/155
9,049,916 B2 6/2015 Berei
9,138,059 B2 * 9/2015 Kwok ..... A47C 7/407
10,238,214 B1 3/2019 Haythornthwaite
10,820,682 B2 11/2020 Jones
2007/0262102 A1 11/2007 Rininger et al.
2009/0084821 A1 * 4/2009 Lenzi ..... A45F 3/08 224/155
2010/0133303 A1 6/2010 Schilly
(Continued)

*Primary Examiner* — Scott T McNurlen
(74) *Attorney, Agent, or Firm* — Wendy W Koba

(57) ABSTRACT

A reconfigurable backpack frame is proposed that may be easily converted into a folding chair when desired. The frame includes a first support member that converts between functioning as a vertical support element (when used as a backpack frame) and a weight-bearing seat (when used as a folding chair). A second support member converts between a horizontal weight-bearing shelf and a chair backrest, using a hinge for this conversion. Additional frame elements convert between being used as structural frame support (and pack attachment) and as chair legs. A pair of frame elements used as front chair legs may include a telescoping mechanism.

9 Claims, 5 Drawing Sheets

(56) References Cited

U.S. PATENT DOCUMENTS

| | | | |
|---|---|---|---|
| 2010/0301078 | A1 | 12/2010 | Tamir et al. |
| 2020/0214451 | A1 | 7/2020 | Garrsison |
| 2020/0268131 | A1 | 8/2020 | McDowell |

* cited by examiner

BACKPACK FRAME CONVERTIBLE TO FOLDING CHAIR

CROSS-REFERENCE TO RELATED APPLICATIONS

This application claims priority from U.S. Provisional Application No. 63/406,284, filed Sep. 14, 2022 and herein incorporated by reference.

TECHNICAL FIELD

The present invention relates to improvements in backpack frame configurations and, more particularly, to a backpack frame that is easily converted into a folding chair when desired.

BACKGROUND OF THE INVENTION

Many people involved in outdoor activities such as hiking or hunting outfit themselves with a backpack to carry essential equipment and food along. In most cases, the type of backpack used for this purpose is mounted on a frame, providing the additional support required for the substantial weight load being carried.

One item that is typically carried along is a small, fold-up stool that is used for various activities, such as fishing, eating, or waiting in a hunting blind. In order to be of a size and shape for carrying along with the backpack, the fold-up stool is usually not very substantial, or comfortable to sit on for extended periods of time.

SUMMARY OF THE INVENTION

The needs remaining in the art are addressed by the present invention, which relates to a backpack frame that is easily converted into a folding chair when desired.

In accordance with the principles of the present invention, a frame structure is proposed that is a combination of a pair of support members and a set of four structural elements. Without needing to add or remove any structural elements to/from the frame structure itself (obviously not taking into account any type of packs and gear attached to the frame), it quickly and easily converts between a backpack frame and a folding chair.

The first and second support members attach to the set of four structural elements. The first support member functions as a vertical surface for supporting a backpack (or other items positioned on the frame), as well as a lumbar support member for an individual wearing the frame. When converted into the folding chair configuration, the first support member functions as a weight-bearing seat. The second support member is used as a weight-bearing horizontal support surface ("shelf") when the frame is being worn, functioning as a bottom surface upon which the gear may rest. When converted into the folding chair configuration, the second support member is rotated to become a back rest. The set of four structural elements are arranged to provide a set of four individual legs for the folding chair configuration, and then move into a different position ("folded") to provide frame support elements in the backpack-carrying frame structure configuration.

Additionally, the set of four structural elements may be described as including: a first (rear) pair of structural elements disposed to attach along opposing terminations of the first support member in a rear area when positioned in the folding chair configuration, and a second (front) pair of structural elements attached to the first pair of frame elements in a one-to-one relationship, the second pair of frame elements extending upward beyond the attachment point to create a pair of distal frame element terminations, with the second support member attached between the second pair of frame elements in proximity to the pair of distal frame element terminations.

Other and further embodiments and configurations of the present invention will become apparent during the course of the following discussion and by reference to the accompanying drawings.

BRIEF DESCRIPTION OF THE DRAWINGS

Referring now to the drawings, where like numerals represent like elements in several views.

DETAILED DESCRIPTION

As will be described in detail below, an exemplary backpack frame of this disclosure may be reconfigured into a folding chair, where the material used to form the frame structure (for example, carbon fiber, aluminum, titanium, polyethylene, or the like) is sufficiently lightweight for the purposes of the frame, but sturdy enough to provide comfortable support as a folding chair. Additionally the frame elements may comprise any suitable cross-section, including but not limited to squared, rectangular, circular, elliptical, or the like.

Figure 2:
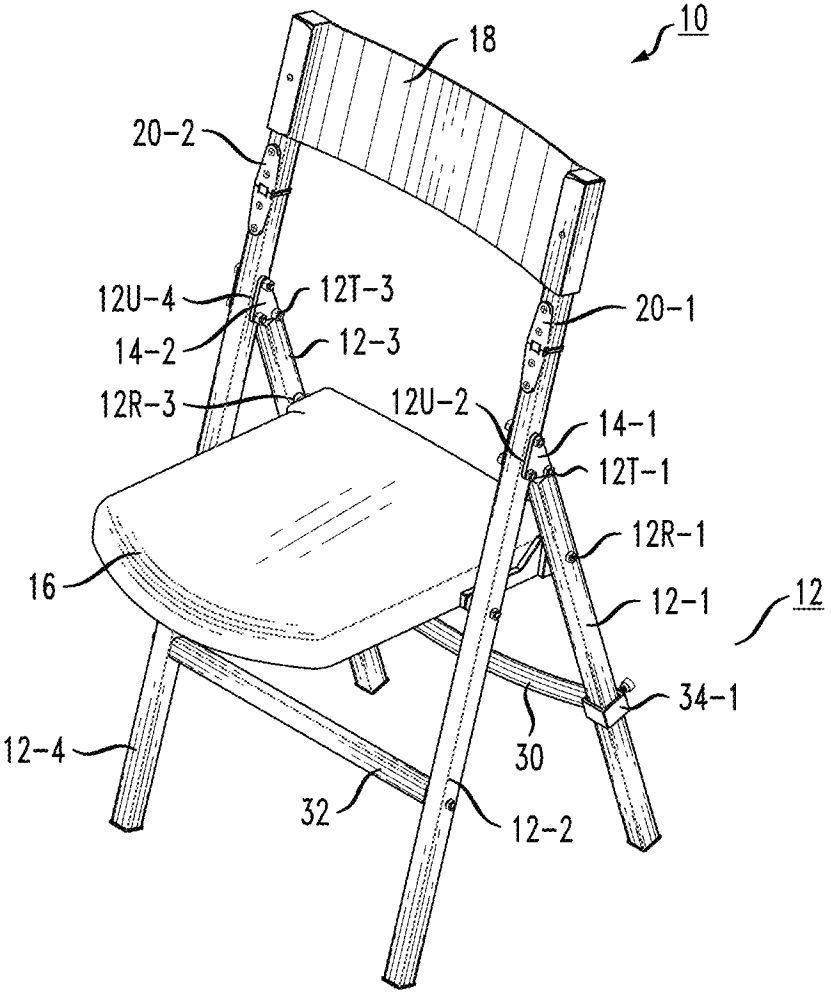
FIG. 2 is an isometric view of the same reconfiguration backpack frame structure as shown in FIG. 1, in this case illustrated in its "folding chair" configuration.
Figure 1:
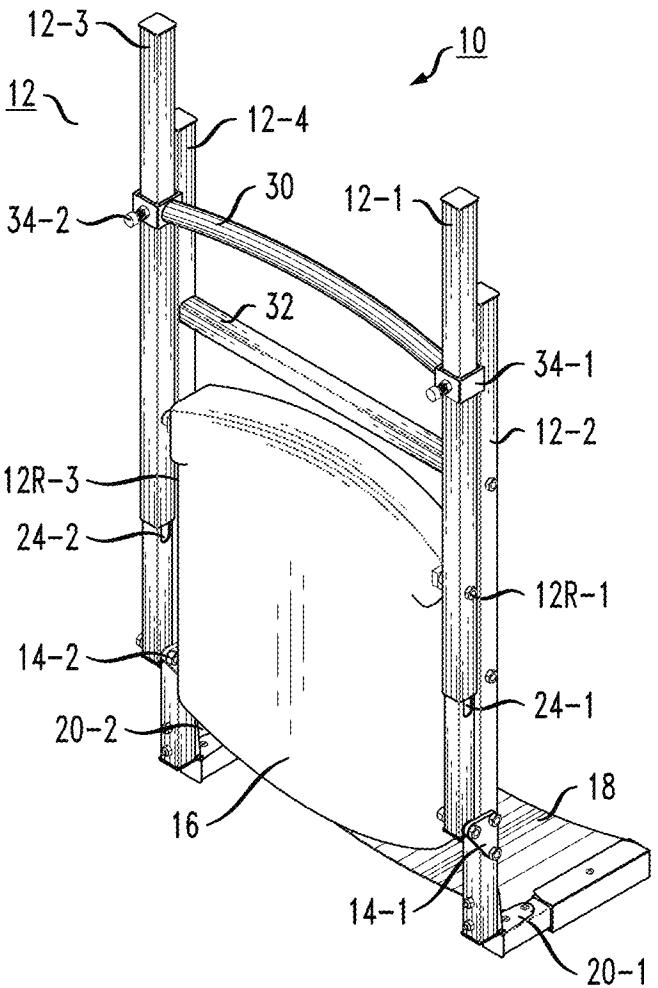
FIG. 1 is an isometric view of an exemplary embodiment of a reconfigurable backpack frame structure formed in accordance with the present invention, shown in its "backpack frame" configuration.

FIG. 1 is an isometric view of a reconfigurable backpack frame 10 formed in accordance with the present invention so as to be easily converted into a folding chair when desired. FIG. 2 is an isometric view of the same backpack frame 10, in this case when it has been converted into its folding chair configuration. An aspect of the present invention that will be discussed in detail below is the inclusion of first and second support members in reconfigurable frame 10. In particular, a first support member 16 converts between functioning as a vertical support element (when used as a backpack frame as shown in FIG. 1) and a weight-bearing seat (when used as a folding chair as shown in FIG. 2). When used as a vertical support, first support member 16 functions as resting surface for an attached backpack (and other items), as well as a lumbar support for the wearer. A second support member 18 converts between functioning as a horizontal weight-bearing support shelf (when used as a backpack frame, FIG. 1) and a backrest (when used as a folding chair, FIG. 2).

Remaining structural components of the inventive frame structure are particularly constructed and utilized to allow for the conversion between backpack frame and a folding chair to be accomplished quickly and efficiently, allowing for an individual to stop and rest as necessary during an extended hike (for example). In particular, reconfigurable backpack frame 10 is shown in FIGS. 1 and 2 as further comprising a plurality of frame elements 12. With reference to FIG. 1, the plurality of frame elements 12 form the vertical members for attaching and securing a backpack (and perhaps other gear) in place on frame 10. Turning to the folding chair configuration of FIG. 2, the plurality of frame elements are "unfolded" in a conventional manner to create the legs of the chair.

In FIGS. 1 and 2, the plurality of frame elements 12 are particularly designated as 12-1, 12-2, 12-3, and 12-4, with frame elements 12-1 and 12-2 coupled together via a first hinge 14-1, and frame elements 12-3 and 12-4 coupled together via a second hinge 14-2. As best shown in FIG. 2, a top end 12T-1 of frame element 12-1 is attached to an upper position 12U-2 of frame element 12-2, with hinge 14-1 used for this attachment. In similar fashion, a top end 12T-3 of frame element 12-3 is attached to an upper position 12U-4 of frame element 12-4 via hinge 14-2. Hinges 14 may comprise separate components that are attached (e.g., bolted or welded) onto frame elements 12 or, possibly, integrally formed as a feature of frame structure 10.

With continuing reference to FIGS. 1 and 2, first support member 16 is shown as attached between rear frame elements 12-1 and 12-3, the attachment locations being designated as 12R-1 and 12R-3, respectively. In accordance with the principles of the present disclosure, second support member 18 is shown in FIGS. 1 and 2 as attached between front frame elements 12-2 and 12-4 via a pair of hinges 20-1 and 20-2, respectively. In particular, second support member 18 is attached to the opposing top end terminations of front frame elements 12-2 and 12-4, as best shown in FIG. 2.

In accordance with the principles of the present invention, hinges 20 are configured to provide a re-positioning of second support member 18 with respect to front frame elements 12-2 and 12-4 between the backpack configuration (FIG. 1), and the folding chair configuration (FIG. 2). In particular, hinges 20 are used to pivot second support member 18 from its horizontal shelf position to the "back rest" configuration when using the folding chair arrangement. The utilization of hinges 20 allows for second support member 18 to be used as a rugged, horizontal surface for supporting a backpack (and other gear) when frame 10 is being worn by an individual. With reference to FIG. 2, hinges 20 then open between front frame elements 12-2, 12-4 and second support member 18 to form this back rest.

Figure 3:
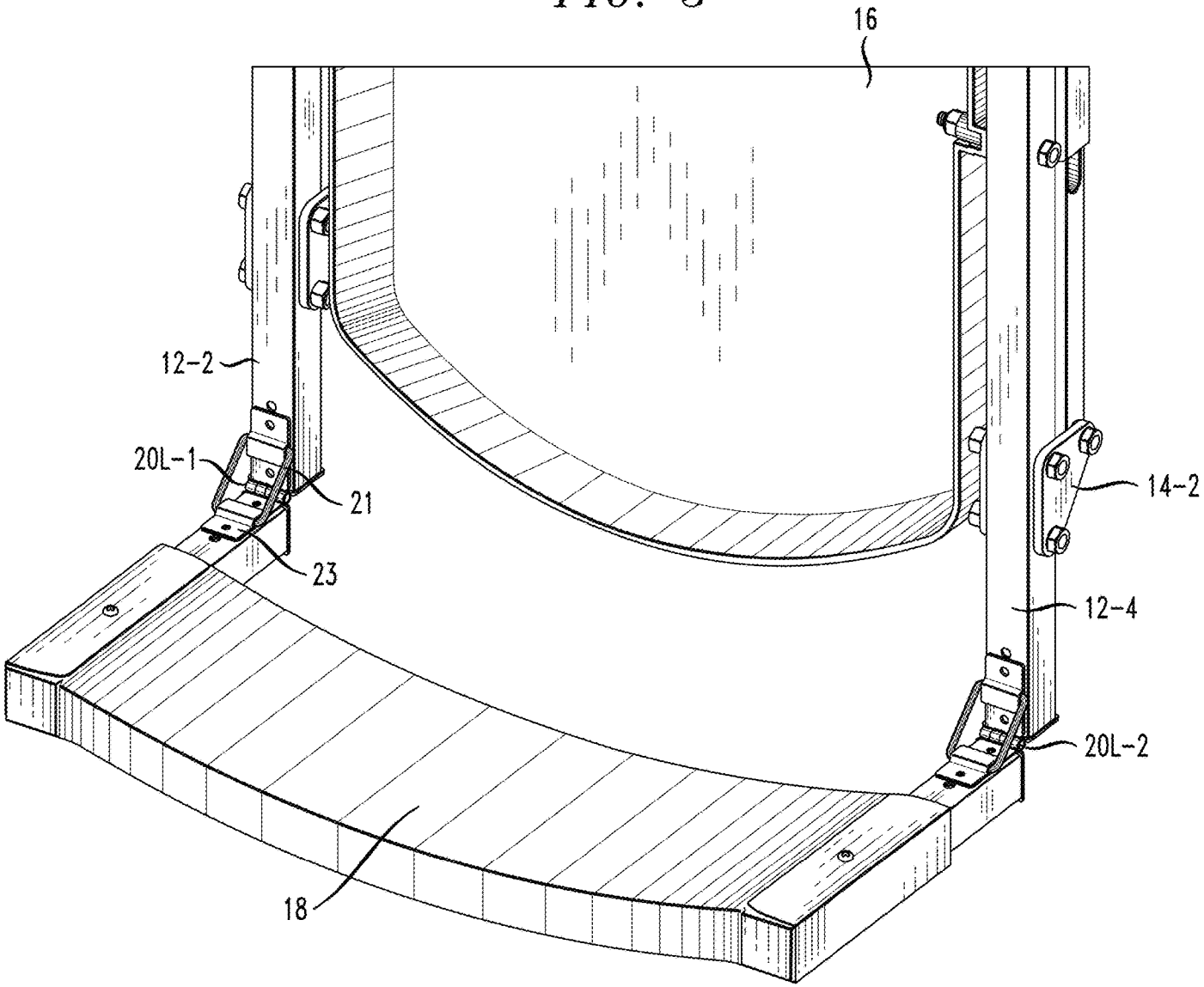
FIG. 3 is an enlarged view of an exemplary hinge configuration used to control the movement of a support member of the inventive frame configuration.

In selected embodiments, hinges 20 may include a releasable locking mechanism to retain second support member 18 its orthogonal position with respect to the remaining frame components when positioned as shown in FIG. 1. In particular, since second support member 18 is used as a weight-bearing shelf, it needs to remain fixed in place (that is, with assurance that hinges 20 will not swing open and permit any stowed items becoming displaced). FIG. 3 is an enlargement of a portion of one example of reconfigurable frame 10, showing a pair of lockable hinges 20L that may be used for this purpose. In this case, an exemplary locking hinge 20L includes a movable bar 21 that engages with a locking surface 23 to minimize the possibility of unwanted movement between second support member 18 and front frame elements 12-1, 12-3.

Figure 4:
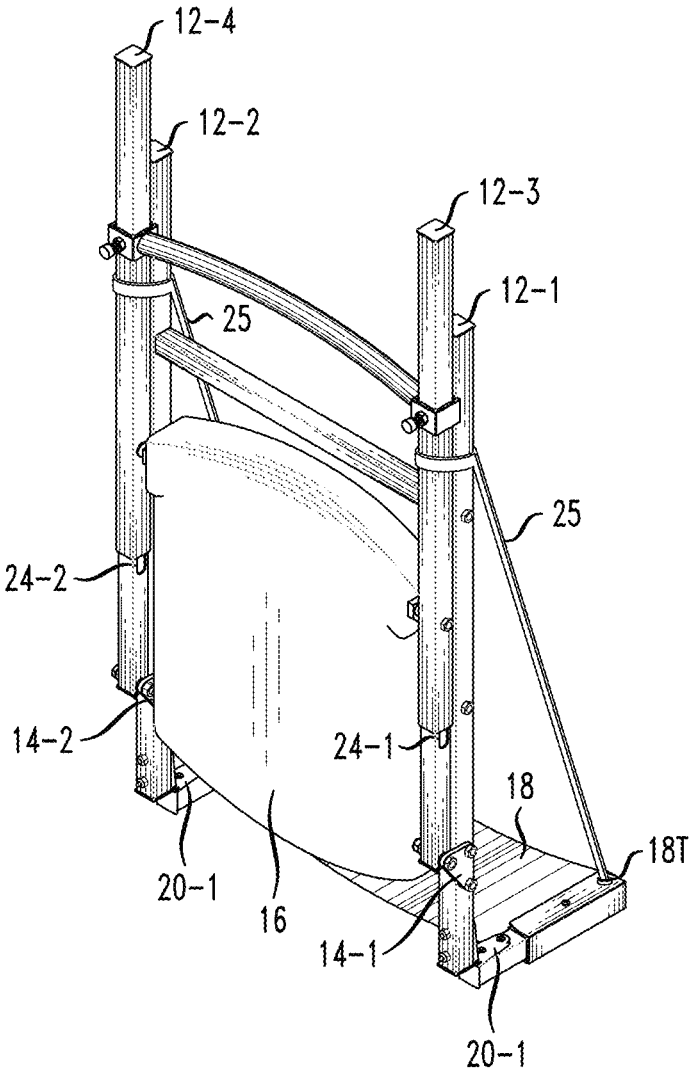
FIG. 4 is an isometric view similar to FIG. 1, in this case further illustrating the use of a pair of securing straps to control the movement of the same support member as shown in FIG. 3.

In an alternative embodiment to a locking hinge, securing straps may be used to hold second support member 18 in place. FIG. 4 illustrates an example of this alternative embodiment, where a pair of securing straps 25 are shown as extending between terminations 18T and an upper area of frame elements 12. In particular, each securing strap 25 is also used to wrap around a "folded together" pair of frame elements (i.e., frame elements 12-1, 12-2 and frame elements 12-3, 12-4). Thus, straps 25 not only maintain second support member 18 is a fixed, stable position, but also prevent frame elements 12 from separating from one another when frame 10 is being worn as a backpack frame. Obviously, there are various other means of holding frame elements 12 together when not being used as a folding chair and there are also various other means of maintain second support member 18 is a fixed position. The arrangements shown in FIGS. 3 and 4 are intended to be illustrative of possible configurations and are not intended to limit the scope of the present invention.

Reconfigurable backpack frame 10 may further include additional structural elements (referred to at times as "bars") that may be used as locations for tying on/securing a backpack, additional structural support (for both the backpack frame and folding chair configurations), additional comfort to an individual wearing the backpack frame, and the like.

With reference to FIGS. 1 and 2, reconfigurable backpack frame 10 is shown as including a back support bar 30 that is attached between front frame elements 12-1 and 12-3. Back support bar 30 may include a slight degree of curvature (as shown) to provide additional comfort for the wearer (see FIG. 1). While only a single back support bar 30 is shown in FIGS. 1 and 2, it is to be understood that additional back support bars may be included, both to provide additional structural/back support and provide additional horizontal members for lashing gear to the frame.

Besides the inclusion of one or more back support bar(s) 30, reconfigurable backpack frame 10 may include one or more brace bars 32 that are attached between rear frame elements 12-2 and 12-4. Brace bar(s) 32 is/are contemplated as helping to maintain a fixed and stationary relationship between frame elements 12-2 and 12-4 when using frame 10 as a folding chair.

In accordance with the principles of the present invention, an exemplary back support bar 30 may be attached to frame elements 12-1, 12-3 by adjustable fasteners 34-1 and 34-2, one example shown in FIGS. 1 and 2. The use of adjustable fasteners, as further discussed below, allows an individual to properly position back support bar 30 up and down along frame elements 12-1, 12-3 (as indicated by the arrows in FIG. 1) to accommodate his/her size and allow the backpack frame to rest at its most comfortable position. It is to be understood that various other types of mechanisms to provide for adjustments of back support bar(s) 30 may be used and are considered to fall within the scope of the present invention.

With the inclusion of any type of additional back support bar 30 and/or brace bar 32, it is contemplated that securing straps 25 may be utilized to wrap around these elements, either in addition to or instead of, frame elements 12.

While not shown in the illustrations, it is presumed that traditional strapping/harness arrangements are attached to frame 10 in a manner that allows for an individual to wear the frame, as well as securely lash a backpack in place on frame 10. Advantageously, a secured backpack will rest on second support member 18, with another surface of the pack resting first support member 16. Various other attachment points to one or more of frame elements 12, back support bars 30, and braces 32 may be used as well to secure a pack.

Figure 6:
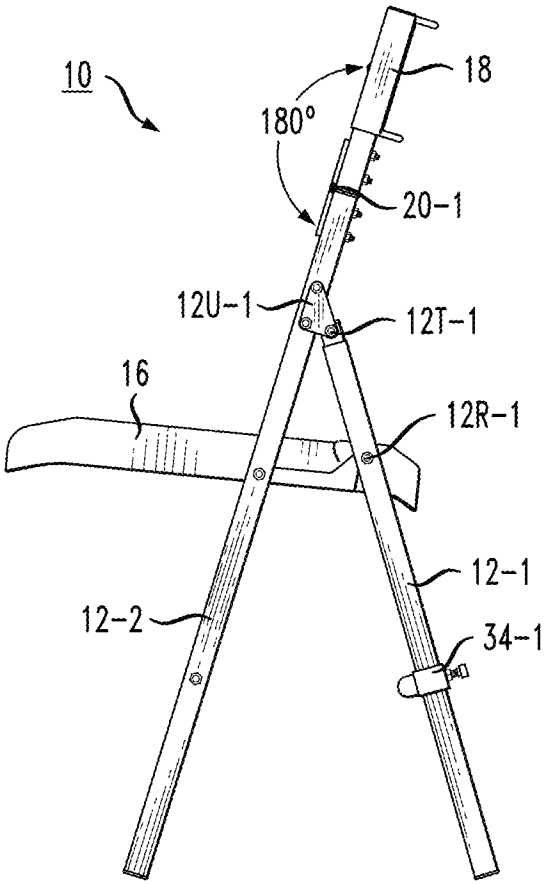
FIG. 6 is a side view of the same embodiment as shown in FIG. 5, in this case illustrated in its folding chair configuration.
Figure 5:
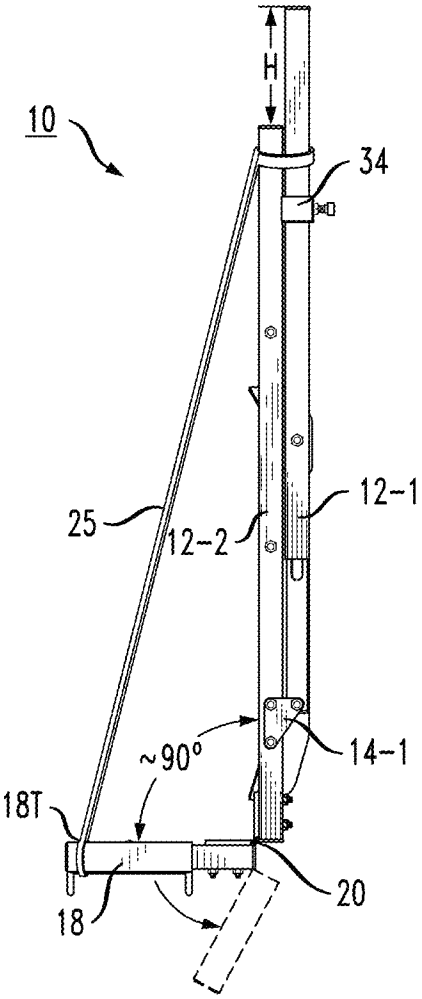
FIG. 5 is a side view of an exemplary embodiment of the inventive frame structure, shown in its backpack frame configuration.

FIG. 5 is a side view of reconfigurable backpack frame 10 in its "carrying" position for hiking with frame 10 used to support a backpack and associated gear. A securing strap 25 is also included in the side view of FIG. 5. FIG. 6 is a side view of the same reconfigurable backpack frame 10 as converted into its folding chair arrangement.

Various embodiments of the inventive reconfigurable frame 10 may utilize adjustable frame elements 12. For example, frame elements 12 may be configured in a "telescoping" design that allows for the length of the individual elements to be adjusted as needed. When using reconfigurable frame 10 as a folding chair, it may be desirous to adjust the length of front frame elements 12-2, 12-4 to control the "pitch" of the chair (e.g., to angle first support member 16 slightly backward and further secure its position as a seat. Additionally, it may be desirable to collapse all four frame elements 12 to as short a length as possible when being worn as a backpack frame to keep the ends of frame elements 12 from being tangled within low-hanging branches or such.

Figure 7:
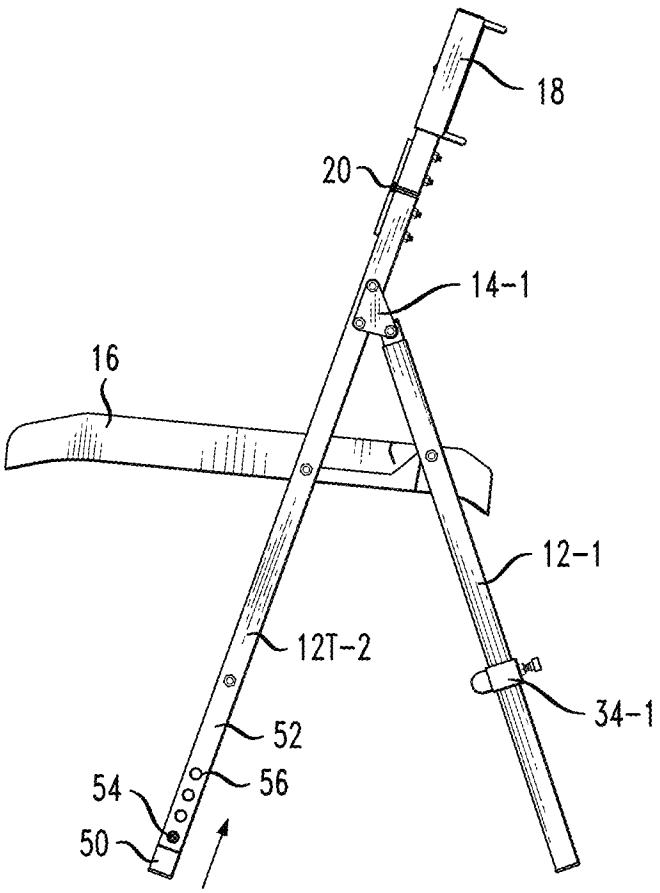
FIG. 7 is a side view of another embodiment of the present invention, in this case including telescoping frame elements.

FIG. 7 is an isometric view of reconfigurable frame 10A, similar to that of reconfigurable frame 10 as shown in FIG. 1, but in this case having frame elements 12-2 and 12-4 formed as telescoping components 12T-2, 12T-4 and thus able to control the spacing between the front and back frame elements when in the folding chair position. In this example, frame element 12T-2 is shown as comprising an inner tubular component 50 inserted within an end opening of an outer tubular component 52. A spring-loaded button 54 formed along inner tubular component 50 may be disposed to releasably engage with a selected one of a plurality of apertures 56 formed along outer tubular component 52. This is only one example of a means for providing adjustment of a telescoping component. Alternatively, an outer surface of inner tubular component 52 may be threaded and engage with an interior threaded surface of outer tubular component 52. Any other suitable configuration may be used. Frame element 12-4 is shown as comprising the same components as frame element 12-2; namely, an inner tubular component 50-3, an outer tubular component 52-3, a set of spring-loaded tabs 54-3, and an aperture 56-3. Again, it is to be understood that rear frame elements 12-1 and 12-3 may be formed in a similar telescoping arrangement to allow for the elements to be shortened as much as possible when worn (i.e., to maintain a low profile for reconfigurable frame structure 10).

Figure 8:
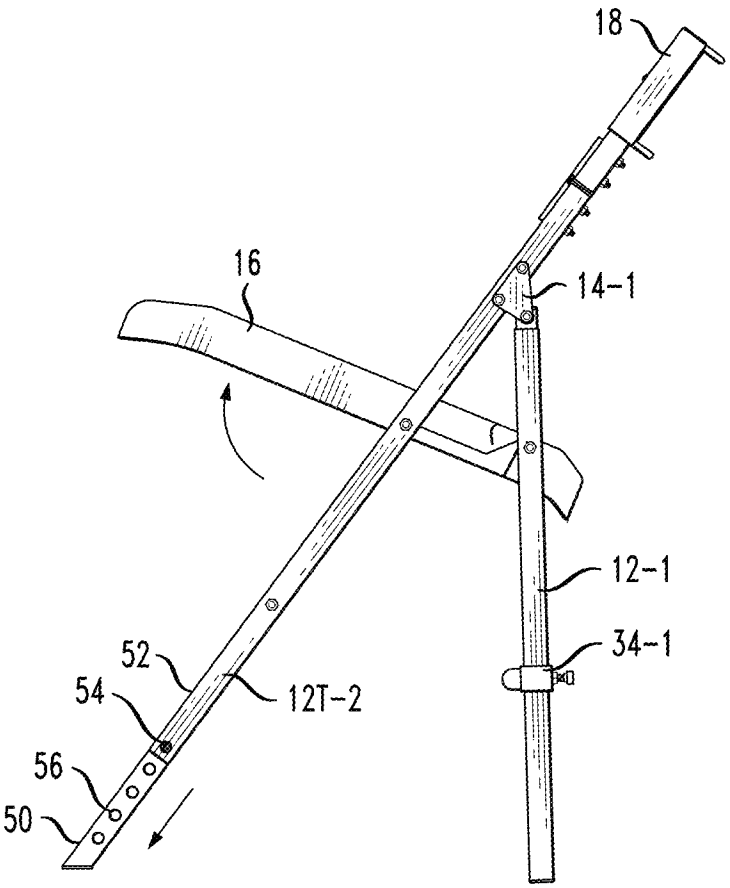
FIG. 8 is another side view of the arrangement of FIG. 7, where in this case the telescoping front frame elements have has been extended, allowing for an adjustment in the orientation of the folding chair with respect to the ground.

FIG. 8 is a side view of reconfigurable frame 10A, in this case illustrating an arrangement where telescoping front frame elements 12T-2 and 12T-4 have been fully extended. The "tilt back" of the folding chair may be exaggerated for the purposes of illustration, but the change in orientation of first support member (seat) 16 with respect to ground is obvious when comparing FIGS. 7 and 8. The inclusion of adjustable frame elements allows the user to find the most comfortable chair position easily and quickly. Additionally, the ability to separately adjust each frame element allows for the user to perhaps perform an "uneven" adjust to account for the terrain on which the folding chair is positioned.

Regarding various materials that may be used to form the inventive reconfigurable backpack, frame elements 12 (as well as bars 30, 32) may be formed of a lightweight, but stiff material, such as carbon fiber, aluminum, titanium, or any other type of material (or combination of materials) that exhibits these necessary properties. Support members 16 and 18 may comprise polyethylene or a similar plastic material. In some embodiments, back support bar 30 may be formed of aluminum, which is somewhat softer than carbon fiber and may be more comfortable when resting against the back of an individual. Titanium may be used for this element as well; indeed, the backpack frame design of the present invention is not limited in the material choices that may be used. The hinges may comprise any of these materials as well; indeed, the choice of materials for any of the components forming the reconfigurable frame structure are design choices of the user. Similarly, the geometry of frame elements 12 (as well as bars 30, 32) are a matter of design choice (for example, all elements may be round in cross-section, elliptical square, rectangular, etc.).

While the invention has been described with reference to preferred and example embodiments, it will be understood by those skilled in the art that a variety of modifications, additions and deletions are within the scope of the invention as defined by the claims attached hereto.

What is claimed is:

1. A frame structure convertible between a backpack-carrying support structure configuration and a folding chair configuration, comprising:

a first support member for use as a lumbar support element in the backpack-carrying support structure configuration and a weight-supporting seat in the folding chair configuration;

a second support member for use as a weight-bearing support shelf in the backpack-carrying support structure configuration and a back rest in the folding chair configuration;

a set of four vertical frame elements arranged to provide a set of four individual legs for the folding chair configuration and to provide frame support elements in the backpack-carrying support structure configuration, the set of four vertical frame elements comprising a first pair of frame elements disposed to attach along opposing terminations of the first support member in a rear area when disposed in the folding chair configuration;

a second pair of frame elements attached to the first pair of frame elements in a one-to-one relationship, the second pair of frame elements extending upward beyond the attachment point to create a pair of distal frame element terminations, with the second support member attached between the second pair of frame elements in proximity to the pair of distal frame element terminations; and a pair of hinged members used to attach the second support member to the second pair of frame elements, allowing for the second support member to be positioned orthogonal to the second pair of frame elements in the weight-bearing support shelf position when the frame structure is in the backpack-carrying support structure configuration and to be positioned colinear with the second pair of frame elements in the back rest position when the frame structure is in the folding chair configuration.

2. The frame structure as defined in claim 1 wherein the pair of hinged members comprises a pair of locking hinged members that remain fixed in either the orthogonal position or the colinear position as controlled by a user.

3. The frame structure as defined in claim 1, further comprising a pair of securing straps, each securing strap coupled between a surface of the second support member and a proximal location along a selected pair of frame elements to maintain the orthogonal position of the second support member, the securing straps being releasable upon reconfiguration of the frame structure in a folding chair arrangement.

4. The frame structure as defined in claim 1 further comprising at least one horizonal back support bar attached to span between the first pair of frame elements.

5. The frame structure as defined in claim 4 where the at least one horizontal back support bar is attached to the first pair of frame elements via a pair of adjustable fasteners useful in adjusting a position of the at least one horizontal back support bar with respect to a size of an individual wearing the frame structure.

6. The frame structure as defined in claim 4 where the at least one horizontal back support bar is curved in a manner to provide comfortable support to an individual wearing the frame structure.

7. The frame structure as defined in claim 1 further comprising at least one brace bar attached to span between the second pair of frame elements.

8. The frame structure as defined in claim 1 wherein at least the second pair of frame elements comprises elements that are adjustable in length.

9. The frame structure as defined in claim 8 wherein at least the second pair of frame elements comprises a pair of telescoping elements.

* * * * *